United States Patent [19]

Baba et al.

[11] 4,140,556

[45] Feb. 20, 1979

[54] ALUMINUM ALLOY SHEET

[75] Inventors: Yoshio Baba; Teruo Uno, both of Nagoya, Japan

[73] Assignee: Sumitomo Light Metal Industries, Ltd., Tokyo, Japan

[21] Appl. No.: 788,157

[22] Filed: Apr. 14, 1977

[30] Foreign Application Priority Data

Apr. 16, 1976 [JP] Japan ..... 51-43138
Feb. 22, 1977 [JP] Japan ..... 52-18377

[51] Int. Cl.[2] ..... C22C 21/06

[52] U.S. Cl. ..... 148/32.5; 75/141; 148/2; 148/12.7 A; 148/159

[58] Field of Search ..... 75/141; 148/32, 32.5, 148/159, 2, 12.7 A

[56] References Cited

U.S. PATENT DOCUMENTS

| | | | |
|---|---|---|---|
| 2,245,167 | 6/1941 | Stroup | 75/141 |
| 3,794,531 | 2/1974 | Markworth et al. | 75/141 |
| 3,935,007 | 1/1976 | Baba et al. | 148/159 |
| 3,993,476 | 11/1976 | Kolke | 75/141 |

*Primary Examiner*—R. Dean
*Attorney, Agent, or Firm*—Browdy and Neimark

[57] ABSTRACT

An aluminum alloy, excellent concurrently in strength and formability, suitably used in car bodies, essentially contains Mg within the range between 3.5 and 5.5%, Zn within the range between 0.5 and 2.0%, and Cu within the range between 0.3 and 1.2%, wherein percents are all by weight; and another still further improved aluminum alloy, excellent concurrently in strength and formability, suitable for similar use, and finer in grain size, indispensably contains all the abovementioned three essential elements in the same ranges of percent by weight, and has optionally added thereto one or more of the elements selected from Mn within the range between 0.05 and 0.4%, Cr within the range between 0.05 and 0.25%, Zr within the range between 0.05 and 0.25%, and V within the range between 0.01 and 0.15%, wherein percents are all by weight.

3 Claims, 2 Drawing Figures

ALUMINUM ALLOY SHEET

BACKGROUND OF THE INVENTION

This invention relates to aluminum alloys excellent in strength and formability, and more particularly pertains to aluminum alloys having a high strength, elongation or ductility, and especially good press-formability for being suitably employed in manufacturing car bodies.

BACKGROUND OF THE INVENTION

There have conventionally been two categories of aluminum alloys for use in car bodies, one is known as nonheat-treatable type alloy such as 5182 Alloy, X5085 Alloy, etc. and the other is heat-treatable type alloys such as AU2G Alloy, 2036 Alloy, etc. These aluminum alloys are generally comparable in respect of mechanical properties to the cold-rolled steel plate widely employed as a material for car bodies, but far inferior in respect of press-formability to the latter. As can be seen in Table I, these aluminum alloys are almost comparable to cold-rolled steel plate in strength, but not in elongation or ductility, so they are practically passable for car body use so far as the strength is concerned; the inferior press-formability of the aluminum alloys in comparison with the cold-rolled steel plate will, however, render the use of the alloys unsatisfactory as a material for press-formed parts for car bodies.

An important or decisive factor for the press-formability of metals is said ductility; a material of high ductility is in general good for press-forming. Even the alloy X5085, being known as the best among aluminum alloys used for car bodies in respect of ductility and having comparatively good press-formability, still shows an unsatisfactory result and is inferior to the cold-rolled steel plate in ductility and thereby in press-formability. The X5085 Alloy is, in addition, not free from a problem in the practical use because of its bad hot-workability.

strength and press-formability suitable for use in car bodies.

It is another object of this invention to provide an improved aluminum alloy which is fine in grain size and thereby high in strength while maintaining press-formability.

It is a still further object of this invention to provide an improved aluminum alloy, strong and rigid, fully resistible in the paint-bake cycle applied thereon.

Other objects and advantages of the present invention will be apparent in view of the following description thereof.

In general, the present invention relates to alloys of aluminum containing magnesium, zinc and copper. In particular, the present invention relates to a first group of such aluminum alloys containing from 3.5 to 5.5% Mg, from 0.5 to 2.0% Zn, from 0.3 to 1.2% Cu and a second group of further containing one or more of the elements selected from rather small amount of manganese, chromium, zirconium, and vanadium in addition to the first group of aluminum alloys.

An improved part of the present invention is the discovery of the critical ranges of proportions of the alloying components as set forth above, which greatly improve the properties of such alloys so as to make them suitable for such applications as car bodies, which require strength, ductility and formability.

DETAILED DESCRIPTION OF PREFERRED EMBODIMENTS

Figure 1A:
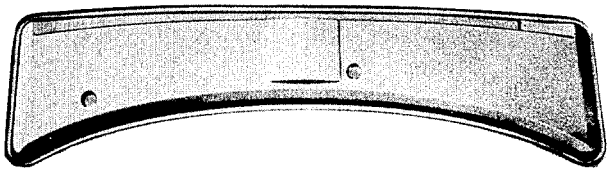
FIG. 1A shows a press-formed tailgate formed of an alloy in accordance with the present invention.

Prior to commencing the detailed description of several preferred embodiments, effects of the three essential components and the four optional components of

TABLE I

| Item | | Temper | Composition (wt%) Cu | Mg | Mn | Al | Mechanical Properties $\sigma_{0.2}$ Yield*1 Strength (Kg/mm²) | $\sigma_B$ Tensile*2 Strength Kg/mm²) | $\delta$ Elongation (%) |
|---|---|---|---|---|---|---|---|---|---|
| Conventional Al-Alloys | 5182 | 0 | — | 4.5 | 0.35 | Balance | 14 | 28 | 25 |
| | X5085 | 0 | — | 6.3 | — | " | 15 | 31 | 28 |
| | AU2G | T4 | 2.4 | 0.45 | — | " | 16 | 28 | 24 |
| | 2036 | T4 | 2.6 | 0.45 | 0.25 | " | 20 | 34 | 24 |
| Cold-Rolled Steel Plate | | — | | | — | | — | 28 or more | 36 or more |

*1Yield Strength is determined by JIS, i.e., the strength at a point with 0.2% permanent residual strain.
*2Tensile Strength or Breaking Strength

SUMMARY OF THE INVENTION

Against such a background development of aluminum alloys for use in car bodies, high in strength e.g. more than 30 Kg/mm² in tensile strength and high in ductility e.g. more than 30%, and excellent in formability is badly needed.

In the alloys which are to be press-formed such as in use of car bodies, it is desirable that the grain size be as fine as possible. And furthermore, materials for car bodies should be strong and rigid enough before and after the often practiced paint-bake cycle over the coated surface.

It is therefore an object of this invention to provide an improved aluminum alloy excellent concurrently in the alloys of this invention and reasons of the ranges specified above, which were experimentally realized, will be explained below. (Percentages used in the composing elements in this specification are all indicated by weight.)

Mg is a strengthening element of the alloys, but it must be within the range between 3.5 and 5.5%. When the content is less than 3.5% the strenthening effect and the formability are both reduced; when the content is more than 5.5% the hot-workability is reduced.

Zn gives the alloys an age-hardenable effect and enables the same to be improved in strength by the natural or room temperature aging after the solution treatment, but its content must be within the range between 0.5 and 2.0%. When the content is less than 0.5% the strengthening effect is insufficient; when the content is more than 2.0%, the ductility is reduced, accompanied by the degraded formability, regardless of remarkable increasing of the strength.

Cu gives the alloys, just like Zn, the natural aging effect and thereby renders the same stronger, but it must be within the range between 0.3 and 1.2%. When the content is less then 0.3% the strengthening effect is insufficient; when the content is more than 1.2% the formability is reduced against expectation, irrespective of remarkable rising of the strength.

Mn is effective in refining the recrystallized grain size as well as in strengthening the alloys but the addition of the same must be within the range between 0.05 and 0.4%. When the content is less then 0.05% the effect is unsatisfactory; when the content is more than 0.4% the ductility is degraded on the contrary.

Cr is effective, if it is added within the range between 0.05 and 0.25%, in refining grains sizes and further strengthening of the alloys. When the content is less than 0.05% the effect is short of expectation; when the content is more than 0.25% giant inter-metallic Cr-compounds occur.

Zr is an effective element, if it is optionally added within the range between 0.05 and 0.25%, for refining the recrystallized grain size and further strengthening the alloys. When the content is less than 0.05% the effect is insufficient; when the content is more than 0.25% giant inter-metallic Zr-compounds occur.

V is also effective, when it is added within the range between 0.01 and 0.15%, in refining the recrystallized grain size and further strengthening the alloys. When the content is less than 0.01% the effect is insufficient; when the content exceeds 0.15% giant inter-metallic V-compounds occur.

Besides, Ti and B are also, just likewise in ordinary aluminum base alloys, effective in refining the casting structure and thereby improving the quality, provided that the Ti content is less than 0.2% and the B content is less than 0.01%.

The aluminum alloys in accordance with this invention will be best in quality when the same are processed through the undermentioned steps. It means the steps are very important factors for getting the alloys of good quality, along with the content ratio of the components.

(a) For homogenizing the ingot structure, a single or multistage soaking is carried out for from 2 to 48 hours at a temperature between 400° and 500° C.

(b) A hot-rolling process at a temperature between 350° and 500° C. follows the above soaking.

(c) After the hot-rolling process, while being annealed if necessary in the course, the ingot shall be cold-rolled into a predetermined thickness.

(d) The final temper (process) may preferably be done under the well-known T4 Temper, which ensures a high degree of ductility of good formability.

(e) And as to the conditions for the T4 Temper, in addition to the normal method of water quenching after a solution treatment at 460° C. for 1 hour, a method of rapid heating in a continuous rapid heating furnace (e.g. at 480° C. for 25 seconds), followed by an air cooling, is also applicable to obtain desired good results.

The present invention will be more readily understandable from a consideration of the following illustrative example.

EXAMPLE 1

As indicated in Table II, 1 mm thick plates which are made from alloys of various content ratio according to the present invention and processed by T4 treatment (by solution heat-treatment at 460° C. followed by water quenching), all show better mechanical properties than the conventional alloys shown in Table I. In short, alloys of the present invention are high in ductility as well as in strength, i.e. more than 30 Kg/mm$^2$ in tensile strength and more than 30% in elongation.

TABLE II

| | Composition (wt %) | | | | Mechanical Properties | | |
|---|---|---|---|---|---|---|---|
| | Mg | Zn | Cu | Al | $\sigma_{0.2}$ Yield Strength (Kg/mm$^2$) | $\sigma_B$ Tensile Strength (Kg/mm$^2$) | $\delta$ Elongation (%) |
| Al-Alloys (I) of the present invention | 4.7 | 0.5 | 0.8 | Balance | 14.0 | 31.4 | 31 |
| | " | 0.8 | " | " | 14.2 | 31.8 | 31 |
| | " | 1.0 | " | " | 14.6 | 32.6 | 31 |
| | " | 1.3 | " | " | 15.1 | 33.0 | 32 |
| | " | 1.5 | " | " | 16.3 | 33.5 | 31 |
| | 4.0 | 1.5 | " | " | 15.6 | 32.8 | 31 |
| | 4.4 | " | " | " | 16.0 | 33.1 | 31 |
| | 5.2 | " | " | " | 17.1 | 34.3 | 32 |
| | 5.2 | 1.0 | " | " | 15.0 | 32.7 | 32 |
| | 4.4 | " | " | " | 14.3 | 32.0 | 31 |
| | 4.0 | " | " | " | 14.0 | 31.5 | 30 |
| | 4.7 | 1.5 | 0.4 | " | 15.0 | 31.0 | 31 |
| | " | " | 0.6 | " | 15.8 | 32.3 | 32 |
| | " | " | 1.0 | " | 17.0 | 34.3 | 31 |
| Comparison | 4.7 | — | — | " | 10.4 | 25.0 | 29 |

EXAMPLE 2

Figure 1B:
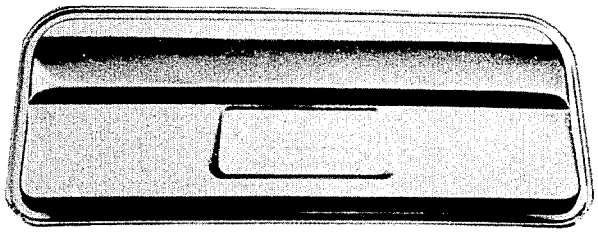
FIG. 1B shows a press-formed ventilator made from an alloy in accordance with the present invention.

A comparison of results as to the press-formability, actually tested on vehicle parts such as a tail gate shown in FIG. 1(A) and a ventilator shown in FIG. 1(B) between the conventional aluminum alloys and an example of the alloys (I) of the present invention (a plate of 1 mm thickness, T4 tempered, that is solution treated at 460° C. followed by water quenching) is shown in Table III.

TABLE III

| Alloys | | Temper | Formability | |
|---|---|---|---|---|
| | | | Tail Gate Outer*1 | Ventilator*2 |
| Alloys (I) of the present invention | Mg 4.7% Zn 1.5% Cu 0.8% Al Balance | T4 | No Crack | No Crack |
| Conventional Alloys for Comparison | 5182 | 0 | Small Crack | Crack |
| | X5085 | 0 | Crack | No Crack |
| | AU2G | T4 | " | Small Crack |
| | 2036 | T4 | " | " |

*1, *2 are shown in Figs. 1A and 1B, respectively.

EXAMPLE 3

As can be seen in Table IV the same invented alloys (I) as in Table III (solution treated at 460° C. for 1 hour) show better results in comparison with the conventional alloys in hydraulic bulging tests. In both of circular bulge and elliptical bulge tests the invented alloys (I) show greater valve than the conventional alloys, which proves the superior press-formability of the former.

TABLE IV

| | Alloys | Temper | Bulge Height at 100 mm diameter bulging | Bulge Height at elliptic bulging with minor dia. 40 mm and major dia. 100 mm |
|---|---|---|---|---|
| Alloys (I) of the present invention | Mg 4.7% Zn 1.5% Cu 0.8% Al Balance | T4 | 31.0 mm | 15.0 mm |
| Conventional Alloys for Comparison | 5182 | 0 | 29.2 | 11.9 |
| | X5085 | 0 | 28.7 | 13.8 |
| | AU2G | T4 | 27.8 | 12.5 |
| | 2036 | T4 | 27.8 | 12.6 |

EXAMPLE 4

The invented alloys (I) can show good mechanical properties even in a condition wherein air cooling is applied after a rapid heating for a short period of time, not being limited to the normal process which requires a water quenching after the solution treatment for one hour at 460° C. An example is shown in Table V, in which alloys of various content ratio (in a form of a plate of 1 mm in thickness rapidly heated at 480° C. for 25 seconds) show good values more than 30 in both the tensile strength (Kg/mm$^2$) and the elongation (%).

TABLE V

| | Composition (wt %) | | | | Mechanical Properties | | |
|---|---|---|---|---|---|---|---|
| | Mg | Zn | Cu | Al | $\sigma_{0.2}$ Yield Strength (Kg/mm$^2$) | $\sigma_B$ Tensile Strength (Kg/mm$^2$) | $\delta$ Elongation (%) |
| Al-Alloys (I) of the present invention | 4.7 | 1.5 | 0.8 | Balance | 16.0 | 32.8 | 31.5 |
| | " | 1.3 | " | " | 14.8 | 32.0 | 32 |
| | " | 1.0 | " | " | 14.3 | 32.0 | 31 |
| | 5.2 | 1.0 | " | " | 14.6 | 32.3 | 32 |
| | 4.4 | " | " | " | 14.0 | 31.5 | 31 |
| | 4.7 | 1.5 | 0.6 | " | 15.3 | 32.0 | 32 |
| | " | " | 1.0 | " | 16.1 | 33.4 | 31 |

EXAMPLE 5

With the alloy ingots of the composition shown in Table VI, after the homogenizing process at 460° C. for 16 hours a hot-rolling process at a temperature of from 440° to 480° C. was carried out down to 5 mm thickness followed by a cold-rolling down to 3 mm thickness, and then an intermediate annealing was done at 400° C. for 2 hours followed by a further cold-rolling down to 1 mm thickness. Afterwards, the cold-rolled plates of 1 mm thickness were solution treated at 460° C. for 1 hour followed by water quenching. Finally T4 tempered plates were obtained after the 30 days natural aging of the plates, the features of which T4 tempered plates are shown in Table VII. It has been proved that the alloys of the present invention containing small amount of additional element or elements are finer in grain size than otherwise alloys, and that the former are higher in the strength even after the T4 Temper as well as after the paint-bake cycle, and also higher or at least equal in formability.

Remark 1: The paint-bake cycle was carried out at 175° C. for one hour followed by air cooling (baking is usually executed at approximately 175° C.).

Remark 2: Circular bulging test on diameter of 100 mm Elliptical bulging test on minor axis 40 mm × major axis 100 mm.

EXAMPLE 6

Some representative samples picked up from the alloys in Table VI were cold-rolled into plates of 1 mm in thickness, by the same method as that in the above Example 5. These cold-rolled plates were then put in a solution process at 480° C. for a short period of 25 seconds followed by air cooling; T4 tempered plates were then obtained after 30 days natural aging, whose features are shown in Table VIII.

Even in this case wherein a solution treatment is carried out by a rapid heating for a short period of time, it has been proved that the alloys containing optional element or elements are, likewise in the previous embodiment, finer in grain size than otherwise alloys, and also high in strength and furthermore, as to the formability, are higher or at least equal to the otherwise alloys.

TABLE VI

| | | Composition (wt %) | | | | | | | | | | |
|---|---|---|---|---|---|---|---|---|---|---|---|---|
| | | Mg | Zn | Cu | Mn | Cr | Zr | V | Ti | Fe | Si | Al |
| Al-Alloys (II)*2 | 1 | 4.7 | 1.3 | 0.8 | 0.15 | — | — | — | 0.06 | 0.12 | 0.09 | Balance |
| | 2 | " | " | " | 0.12 | 0.08 | — | — | 0.04 | " | 0.07 | " |
| | 3 | " | " | " | — | 0.15 | — | — | 0.07 | 0.11 | " | " |
| | 4 | " | " | " | — | — | 0.15 | — | 0.05 | 0.13 | " | " |
| | 5 | 4.7 | 1.5 | 0.6 | 0.11 | 0.09 | — | — | 0.04 | 0.12 | 0.08 | " |
| | 6 | " | " | " | 0.16 | — | — | — | 0.02 | " | 0.06 | " |
| | 7 | " | " | " | — | 0.1 | 0.1 | — | 0.03 | 0.11 | 0.05 | " |
| | 8 | 4.2 | 1.5 | 0.4 | 0.13 | 0.08 | — | — | 0.02 | 0.13 | 0.07 | " |
| | 9 | " | " | " | — | 0.14 | 0.08 | — | 0.06 | " | 0.06 | " |
| | 10 | " | " | " | 0.17 | — | — | — | 0.05 | " | 0.08 | " |
| | 11 | 4.7 | 1.3 | 0.8 | — | — | — | 0.07 | 0.03 | 0.11 | " | " |
| | 12 | " | " | " | — | — | — | 0.12 | 0.02 | " | " | " |
| | 13 | " | " | " | 0.13 | — | — | 0.08 | 0.03 | " | 0.07 | " |
| | 14 | " | " | " | — | 0.10 | — | 0.04 | 0.04 | 0.13 | " | " |
| | 15 | " | " | " | — | — | 0.09 | 0.08 | " | 0.12 | " | " |
| | 16 | " | 1.5 | 0.6 | — | — | — | " | 0.03 | 0.14 | " | " |
| | 17 | 4.2 | " | 0.4 | — | — | — | 0.07 | 0.04 | " | 0.08 | " |
| | 18 | " | " | " | 0.09 | — | — | " | " | 0.12 | 0.06 | " |
| Al-Alloys (I)*1 | A | 4.7 | 1.3 | 0.8 | — | — | — | — | 0.03 | " | 0.08 | " |
| | B | " | 1.5 | 0.6 | — | — | — | — | 0.04 | 0.15 | " | " |
| | C | 4.2 | " | 0.4 | — | — | — | — | 0.05 | 0.11 | 0.07 | " |

*1Al-Alloy of the present invention.

*2Al-Alloy of the present invention containing one or more of Mn, Cr, Zr, and V.

TABLE VII

| | | Mechanical properties for T4 tempered plate (1 mm in thickness) | | | Mechanical properties for T4 tempered plate after paint-bake cycle (1 mm in thickness) | | | Grain size, diameter | Bulge height (hydraulic) | | | Ericsen value |
|---|---|---|---|---|---|---|---|---|---|---|---|---|
| | | $\sigma_{0.2}$ Kg/mm$^2$ | $\sigma_B$ Kg/mm$^2$ | $\delta$ % | $\sigma_{0.2}$ Kg/mm$^2$ | $\sigma_B$ Kg/mm$^2$ | $\delta$ % | $10^{-3}$ mm | at a circle mm | at a elipse mm | LOB* | mm |
| Al-Alloys (II) | 1 | 17.1 | 35.6 | 32 | 17.6 | 36.0 | 30 | 18 | 31.0 | 15.1 | 2.17 | 9.8 |
| | 2 | 17.8 | 36.0 | " | 18.5 | 36.3 | 29 | 15 | 31.1 | " | " | " |
| | 3 | 18.7 | 36.2 | " | 19.0 | 36.0 | " | 18 | " | 14.9 | " | " |
| | 4 | 17.4 | 35.3 | 31 | 17.8 | " | " | 16 | 30.8 | " | " | " |
| | 5 | 18.6 | 36.0 | 32 | 19.5 | 36.7 | 30 | " | 31.2 | 15.0 | " | " |
| | 6 | 18.4 | 36.0 | " | 19.2 | 36.6 | 29 | 17 | 31.1 | " | " | " |
| | 7 | 18.7 | 35.8 | " | 19.7 | 36.8 | 30 | 15 | 30.9 | 14.7 | " | " |
| | 8 | 17.2 | 34.8 | 31 | 16.7 | 34.0 | " | " | 30.8 | 14.9 | 2.16 | 9.7 |
| | 9 | 17.6 | 34.5 | " | 17.0 | 33.8 | 29 | " | " | 14.8 | " | " |
| | 10 | 17.3 | 34.9 | " | " | 34.0 | " | " | 30.7 | " | " | " |
| | 11 | 17.6 | 35.7 | 33 | 18.5 | 36.6 | 30 | 17 | 31.5 | 15.4 | 2.18 | 10.0 |
| | 12 | 18.7 | 35.8 | " | 19.7 | 37.2 | " | 15 | " | " | " | " |
| | 13 | 19.2 | 36.5 | 32 | 19.9 | 37.0 | 29 | " | 31.3 | 15.2 | 2.17 | 9.8 |
| | 14 | 19.5 | 36.6 | " | 20.5 | 37.4 | 30 | 16 | 31.1 | " | " | " |
| | 15 | 18.9 | 35.7 | 31 | 19.8 | 36.6 | 29 | 17 | 31.0 | 15.0 | " | 9.7 |
| | 16 | 19.0 | 36.5 | 32 | 19.5 | 37.0 | " | 18 | 31.4 | 15.2 | " | 9.8 |
| | 17 | 17.3 | 34.6 | 31 | 17.0 | 34.0 | " | 17 | 31.1 | 14.9 | 2.16 | 9.7 |
| | 18 | 17.8 | 34.9 | " | 17.4 | 34.3 | 28 | 16 | " | 15.0 | " | " |
| Al-Alloys (I) | A | 15.1 | 33.0 | 32 | 15.5 | 33.4 | 29 | 48 | 31.0 | " | 2.17 | " |
| | B | 15.8 | 32.3 | " | 16.6 | 33.0 | 30 | 48 | 31.2 | 14.9 | " | " |
| | C | 14.6 | 31.8 | 31 | 14.1 | 31.0 | " | 45 | 30.8 | 14.7 | 2.16 | 9.6 |

*Limiting Drawing Ratio

TABLE VIII

| | | Mechanical properties for T4 tempered plate (1 mm in thickness) | | | Mechanical properties for T4 tempered plate after paint-bake cycle (1 mm in thickness) | | | Grain size, diameter | Bulge height (hydraulic) | | | Ericsen value |
|---|---|---|---|---|---|---|---|---|---|---|---|---|
| | | $\sigma_{0.2}$ Kg/mm$^2$ | $\sigma_B$ Kg/mm$^2$ | $\delta$ % | $\sigma_{0.2}$ Kg/mm$^2$ | $\sigma_B$ Kg/mm$^2$ | $\delta$ % | $10^{-3}$ mm | at a circle mm | at a elipse mm | LDR* | mm |
| Al-Alloys (II) | 1 | 16.7 | 35.0 | 32 | 17.2 | 35.6 | 29 | 12 | 31.0 | 15.1 | 2.17 | 9.8 |
| | 2 | 17.2 | 35.5 | 32.5 | 17.6 | 36.0 | 30 | " | 31.1 | " | " | " |
| | 5 | 18.3 | 35.4 | " | 18.9 | " | " | 13 | 31.2 | 15.0 | " | " |
| | 8 | 16.8 | 34.0 | 31 | 16.3 | 33.5 | 29 | " | 30.8 | " | 2.16 | 9.7 |
| | 11 | 17.3 | 35.5 | 34 | 18.0 | 36.0 | 30 | 12 | 31.6 | 15.5 | 2.18 | 10.2 |
| | 12 | 18.2 | 35.4 | 33.5 | 18.7 | 36.4 | " | " | " | " | " | " |
| | 14 | 18.8 | 36.2 | 32 | 19.4 | 36.8 | 29 | " | 31.1 | 15.2 | 2.17 | 9.8 |
| | 16 | 18.4 | 36.0 | 33 | 18.9 | 36.4 | " | " | 31.4 | " | 2.18 | 9.9 |
| Al-Alloys (I) | A | 14.8 | 32.0 | 32 | 15.3 | 32.6 | " | 35 | 31.0 | 15.0 | 2.17 | 9.7 |
| | B | 15.3 | " | " | 15.7 | 32.7 | 30 | 38 | 31.2 | 14.9 | " | " |
| | C | 14.4 | 31.3 | 31 | 14.0 | 30.8 | 29 | 36 | 30.8 | 14.7 | 2.16 | 9.6 |

*Limiting Drawing Ratio

What is claimed is:

1. An aluminum alloy sheet for use in car bodies, said sheet produced by the process comprising:

forming an aluminum alloy ingot consisting of 3.5–5.5% Mg, 0.5–2.0% Zn, 0.3–1.2% Cu and the balance aluminum and inevitable impurities, all percents being by weight;

homogenizing said ingot under a single or multi-stage soaking process at a temperature between 400° and 500° C. for 2–48 hours;

reducing in thickness by hot rolling at a temperature between 350° and 500° C.;

further reducing in thickness by cold rolling down to a thickness of about 1.0 mm; and T4 tempering by the solid solution process at about 460° C. for 1 hour accompanied by recrystallization by water quenching, or by rapid heating at about 480° C. for about 25 seconds followed by air cooling, and age hardening by natural age hardening for not more than about 30 days, thereby imparting to the sheet, concurrently, tensile strength of not less than 30 kg/mm$^2$ and elongation of not less than 30%.

2. An aluminum alloy sheet for use in car bodies, said sheet produced by the process comprising:

forming an aluminum alloy ingot consisting of 3.5–5.5% Mg, 0.5–2.0% Zn, 0.3–1.2% Cu, at least one element selected from the group consisting of 0.05–0.4% Mn, 0.05–0.25% Cr, and 0.01–0.15% V, and the balance aluminum and inevitable impurities, all percents being by weight;

homogenizing said ingot under a single or multi-stage process at a temperature between 400° and 500° C. for 2–48 hours;

reducing in thickness by hot rolling at a temperature between 350° and 500° C.;

further reducing in thickness by cold rolling down to a thickness of about 1.0 mm; and T4 tempering by the solid solution process at about 460° C. for 1 hour accompanied by recrystallization by water quenching, or by rapid heating at about 480° C. for about 25 seconds followed by air cooling, and age hardening by natural age hardening for not more than about 30 days, thereby imparting to the sheet, concurrently, tensile strength of not less than 30 kg/mm$^2$ and elongation of not less than 30%.

3. An aluminum alloy sheet for use in car bodies, said sheet produced by the process comprising:

forming an aluminum alloy ingot consisting essentially of 3.5–5.5% Mg, 0.5–2.0% Zn, 0.3–1.2% Cu, at least one element selected from the group consisting of 0.05–0.4% Mn, 0.05–0.25% Cr, 0.01–0.15% V, and 0.05–0.25% Zr, and the balance essentially aluminum and inevitable impurities, all percents being by weight;

homogenizing said ingot under a single or multi-stage process at a temperature between 400° and 500° C. for 2–48 hours;

reducing in thickness by hot rolling at a temperature between 350° and 500° C.;

further reducing in thickness by cold rolling down to a thickness of about 1.0 mm; and T4 tempering by the solid solution process at about 460° C. for 1 hour accompanied by recrystallization by water quenching, or by rapid heating at about 480° C. for about 25 seconds followed by air cooling, and age hardening by natural age hardening for not more than about 30 days, thereby imparting to the sheet, concurrently, tensile strength of not less than 30 kg/mm$^2$ and elongation of not less than 30%.

* * * * *